US009200471B2

(12) United States Patent
Froese

(10) Patent No.: US 9,200,471 B2
(45) Date of Patent: Dec. 1, 2015

(54) MOUNTING ACCESSORY FOR SECURE ATTACHMENT OF RAILS TO PIPE-MOUNTED HOLLOW POSTS

(76) Inventor: Joseph S. Froese, Edmonton (CA)

( * ) Notice: Subject to any disclaimer, the term of this patent is extended or adjusted under 35 U.S.C. 154(b) by 1004 days.

(21) Appl. No.: 13/342,460

(22) Filed: Jan. 3, 2012

(65) Prior Publication Data

US 2013/0168627 A1 Jul. 4, 2013

(51) Int. Cl.

| | |
|---|---|
| ***E04H 7/00*** | (2006.01) |
| ***E04H 17/14*** | (2006.01) |
| *E04G 21/32* | (2006.01) |

(52) U.S. Cl.

CPC ..... *E04H 17/1413* (2013.01); *E04G 21/3233* (2013.01); *E04H 2017/1452* (2013.01); *Y10T 29/4987* (2015.01); *Y10T 29/49947* (2015.01)

(58) Field of Classification Search

CPC ..... E04H 17/1413; E04H 2017/1452; E04G 21/3233

USPC ..... 256/19, 65.02–65.06, 65.14, DIG. 5; 52/296, 297, 655.1; 248/218.4, 219.1, 248/219.2, 228.6, 230.6, 231.71, 316.7, 248/316.1

See application file for complete search history.

(56) References Cited

U.S. PATENT DOCUMENTS

| | | | | |
|---|---|---|---|---|
| 4,269,106 | A * | 5/1981 | Leibhard et al. | 411/34 |
| 5,170,578 | A * | 12/1992 | Pampel | 40/316 |
| 6,213,452 | B1 * | 4/2001 | Pettit et al. | 256/59 |
| 7,137,230 | B2 | 11/2006 | McCarthy | |
| 7,152,841 | B2 * | 12/2006 | Callies | 248/530 |
| 7,194,829 | B2 * | 3/2007 | Boire et al. | 40/316 |
| 7,455,282 | B2 | 11/2008 | Platt | |
| 7,530,550 | B2 | 5/2009 | Fattori | |
| 7,533,854 | B2 * | 5/2009 | Aube | 248/95 |
| 7,614,819 | B1 * | 11/2009 | Mirman et al. | 404/6 |
| 7,739,796 | B2 | 6/2010 | Froese | |
| 7,850,148 | B2 * | 12/2010 | Collins, IV | 256/65.14 |
| 8,382,047 | B1 * | 2/2013 | Hildebrand | 248/79 |
| 8,453,372 | B1 * | 6/2013 | Moe | 43/21.2 |

* cited by examiner

*Primary Examiner* — Gregory Binda
*Assistant Examiner* — Nahid Amiri
(74) *Attorney, Agent, or Firm* — Kyle R. Satterthwaite; Ryan W. Dupuis; Ade & Company Inc.

(57) ABSTRACT

A mounting accessory is used for secure connection of a rail or other component to a hollow post positioned over an internal upright by a mounting device having an axial passage through which the upright extends. The accessory features interconnected walls facing into an open space left therebetween, the open space being sized to accommodate passage of the upright support therethrough with the mounting accessory oriented to situate the walls on different sides of the upright support. Each wall has an opening therein sized to accommodate a respective portion of the periphery of the mounting device. With a portion of the mounting device periphery received in the opening of each wall, the wall resides at or adjacent the periphery of the device to lie internally adjacent a respective wall of the post to provide extra material for engagement by a screw fastener driven through the post wall.

14 Claims, 7 Drawing Sheets

MOUNTING ACCESSORY FOR SECURE ATTACHMENT OF RAILS TO PIPE-MOUNTED HOLLOW POSTS

FIELD OF THE INVENTION

The present invention relates generally to fencing and railing structures involving the support of transverse rails between pairs of upright posts, and more particularly to methods and apparatuses for secure fastening of such rails to hollow posts that are supported on poles or pipes positioned thereinside.

BACKGROUND OF THE INVENTION

Plastic rail assemblies, for example for use in fencing and decking, are gaining popularity due to their durability and pleasant appearance. Unlike wood used in conventional fencing or decking rail assemblies, the plastic components, typically made of polyvinyl chloride (PVC), do not require post-sale painting and weatherproofing and will not rot over time. Rail assemblies feature horizontal rails, or sloped rails when used as a stair railing, supported on and extending between vertical posts spaced apart along a straight line. Hollow PVC posts are fitted over and supported around rigid pipes that provide the necessary strength to support the final structure in a stable and reliable manner over time. The rigid pipe may be supported by driving a lower end thereof a distance into the ground or by anchoring it to some kind of foundation or support surface that is provided on, in, or above the ground. Different devices have been developed for positioning the hollow post about the pipe for each of these situations.

A recognized issue with the use of hollow posts in this manner is that the walls of the hollow post are relatively thin, especially compared to a conventional solid wood post, and accordingly when screw-type fasteners are used to attach a rail or other component to the hollow post, the depth of material available for engagement in the axial direction of the fastener is minimal. As a result, screwing the rail to the hollow post alone is often insufficient to establish a desired or required level of strength and durability for this connection, especially where the rail is expected to bear the weight of pickets, panels, studs, or other components of the overall railing structure, particularly any components that are not light-weight plastic, or where the rail is intended to act as a protective barrier that is expected to be able to prevent a fall from an elevated area bound one or more sides by the railing structure or bear, or act as hand railing providing for providing support of a user while traversing a series of steps.

Previous solutions to this problem have been proposed, each involving the mounting of a fixture onto the pipe to present additional sections of fastener-engagable material at a distance outward from the pipe just inside the hollow post placed thereover. Examples of these solutions are listed as follows.

U.S. Pat. No. 7,137,230 teaches a device that is designed to fit over an upright pipe at an intermediate location therealong to present planar metal flanges a short distance outward therefrom to brace against planar walls of a hollow post and provide additional material for screws to bite into when attaching rails, studs or the like to the post.

U.S. Pat. No. 7,455,282 teaches a device having a socket at its lower end arranged to seat atop an upright pipe around which a hollow post is to be supported, and a rectangular upper portion presenting four planar walls to brace against planar walls of a hollow post and provide additional material for screws to bite into when attaching rails to the post.

U.S. Pat. No. 7,530,550 teaches a device having a tubular body for fitting over an upright of rectangular cross-section, and pairs of mounting panels connected to the tubular body and extending therefrom to present resilient sections adjacent the inside of a hollow post to be fitted over the upright in order to receive and retains fasteners driven through the walls of the post.

Each of the forgoing prior art solutions appears to have a shortcoming in that the fastener-engagable fixture residing inside the hollow post is mounted directly on the upright pipe, and so the absolute position of the parts of the fixture that are intended to rest just inside the hollow post are is dictated by the position and orientation of the upright pipe.

Applicant's U.S. Pat. No. 7,739,796, the entirety of which is incorporated herein by reference, teaches multi-piece mounting devices shown in FIGS. 8 to 11 thereof that each allow repositioning of the outer periphery of an outermost piece of the device relative to the pipe on which the innermost piece is mounted by disengaging the outermost piece from the innermost piece and then re-engaging these pieces together in a different one of a number of selectable relative positions therebetween, thereby allowing a user to set the final position of the outer periphery of the device relative to the pipe to as to be able to adjust the final position of the post that is in turn fitted over the outermost piece around the pipe. Accordingly, the user can use one of these devices at a distance upward from the a supported bottom portion of the post, which may be supported by a mounting device of the same or different type, to select a degree of relative alignment between the axis of the pipe and the axis of the post, for example to allow a vertical orientation of the post on a pipe that may be angled somewhat out of an entirely vertical orientation.

With further reference to FIG. 12 thereof, Applicant's same patent also teaches a one-piece mounting device that allows for similar angular adjustment between the pipe and the hollow post to be mounted thereover. This device includes a tubular portion defining an opening of uniform cross-section having one dimension selected to slightly exceed the pipe's outer diameter, and the other dimension selected to significantly exceed the first, giving the opening an elongated shape. A cylindrical outer wall of is carried around the tubular central portion at a distance outward therefrom by a webbing, and features a circular outer periphery and an axial height spanning only a part of the tubular portion's length. The opening is placed over the pipe, and its elongated dimension allows shifting of the piece back and forth in radial directions relative to the pipe axis to allow user-controlled positioning of the outer cylindrical wall relative to the pipe axis, before fastening of the part of the tubular portion that is not concealed by the outer wall to the pipe.

The prior art hollow post rail attachment solutions referenced above are not compatible with the Applicant's system for selective angling between the pipe and the hollow post to be mounted thereon, as they attach directly to the pipe and have fixed dimensions and thus only fit within the hollow post if the post is installed in a prescribed position concentric with the pipe.

Accordingly, Applicant has developed new methods and apparatuses for providing additional screw-engagable material inside a hollow post in a manner that is compatable with the aforementioned devices for setting the post position/angle relative the upright pipe.

SUMMARY OF THE INVENTION

According to a first aspect of the invention there is provided an internal mounting accessory for a hollow post positioned over an internal upright support by a mounting device having an axial passage through which the upright support is passable and having an outer periphery facing outwardly away from the passage at a distance outward therefrom, the internal mounting accessory comprising a plurality of interconnected walls having inner faces facing into an open space left between said walls, the open space being sized to accommodate passage of the upright support therethrough with the mounting accessory oriented to situate the walls on different sides of the upright support, each wall having an opening therein sized to accommodate a respective portion of the periphery of the mounting device.

Preferably a connection between two of the plurality of walls comprises a resilient area that is flexible out of a normal default condition to enable selective moving of the inner faces of the two walls away from one another.

Preferably said two walls are connected end to end and, with the connection in the normal condition, lie in perpendicular planes.

Preferably the plurality of walls comprises a third wall connected end to end with one of said two walls to lie parallel to the other of said two walls with the connection in the normal condition.

Preferably there is provided an additional connection between a third wall and a first one of said two walls, the additional connection comprising an additional resilient area that is flexible out of a respective normal default condition to enable selective moving of the third wall away from the inner faces of said two walls.

Preferably the third wall is perpendicular to the first one of said two walls with the additional connection in the respective normal condition.

Preferably the plurality of walls consists of said three walls.

Preferably the opening in each wall is disposed between, and spaced from each, of top and bottom ends of said wall.

Preferably at least one wall of the plurality of walls comprises a slot that is narrower than the opening in said wall and that extends from said opening to a respective one of the top and bottom ends of said wall.

The mounting accessory may be provided in combination with the mounting device, wherein said mounting device comprises an outer cylindrical wall defining the periphery of said mounting device on a circular path around the passage, the openings in the walls of the internal mounting device being positioned to seat at least a portion of an upper boundary of each opening over a top end of the cylindrical wall.

The mounting device may feature inwardly projecting features connecting to the top end of the cylindrical wall and extending inwardly from the cylindrical wall to boundaries of the passage.

The inwardly projecting features of the mounting device may include a plurality of such features fully surrounding the passage around the cylindrical wall.

The inwardly projecting features of the mounting device may include web portions connected between the cylindrical wall and side walls projecting upward from the web portions at respective sides of the passage.

Preferably the openings in the walls are rectangular in shape.

Preferably the walls are rectangular in shape.

Each wall may extend both upwardly and downwardly past the opening therein.

According to a second aspect of the invention there is provided a method of connecting a railing to a post assembly, the method comprising:

installing a mounting device on an upright support such that the upright support extends upwardly through a passage in the mounting device and the mounting device presents an outer periphery facing outwardly away from the passage at a distance outward therefrom;

installing a mounting accessory on the mounting device to present a planar face on a side of the upright support in a position adjacent the periphery of the mounting device;

installing a hollow post over the upright support, mounting device and mounting accessory to form the post assembly in which a respective wall of the hollow post lies over to the planar face of the mounting accessory;

securing an attachment feature of the railing to the hollow post by engaging at least one fastener into the respective wall of the hollow post and onward through said wall the planar face of the mounting accessory, whereby engagement of the fastener into the mounting accessory provides an improved connection strength between the railing and the post assembly compared to engagement of the with only the hollow post of the post assembly.

Preferably installing the mounting accessory comprises seating a portion of the mounting accessory atop the mounting device.

Installing the mounting accessory comprises fastener free engagement of the mounting accessory to the mounting device.

Preferably the mounting accessory comprises a plurality of interconnected walls having inner faces facing into an open space left between said walls, the open space being sized to accommodate passage of the upright support therethrough.

Preferably the step of installing of the mounting accessory comprises engaging a respective portion of the periphery of the mounting into an opening in each wall of the mounting accessory.

Preferably the step of installing the mounting accessory comprises flexing a resilient portion of the mounting accessory to move two of the walls thereof away from one another to fit the mounting device between said two walls, and with the openings in the walls of the mounting accessory aligned with respective sides of the periphery of the mounting device, releasing the two walls to resiliently return them to a normal default condition relative to one another, thereby engaging portions of the mounting device's periphery into the openings to seat at least a portion of an upper boundary of each opening on the mounting device to support the mounting accessory thereon.

According to a third aspect of the invention there is provided an internal mounting accessory for a hollow post positioned over an internal upright support by a mounting device having an axial passage through which the upright support is passable and an outer cylindrical wall facing outwardly away from the passage on a circular path therearound, the internal mounting accessory comprising a plurality of interconnected walls having inner faces facing into an open space left between said walls, the open space being sized to accommodate passage of the upright support therethrough with the mounting accessory oriented to situate the walls on different sides of the upright support, each wall having an opening therein sized to accommodate a respective arcuate portion of the cylindrical wall of the mounting device.

BRIEF DESCRIPTION OF THE DRAWINGS

In the accompanying drawings, which illustrate an exemplary embodiment of the present invention.

DETAILED DESCRIPTION

Figure 1:
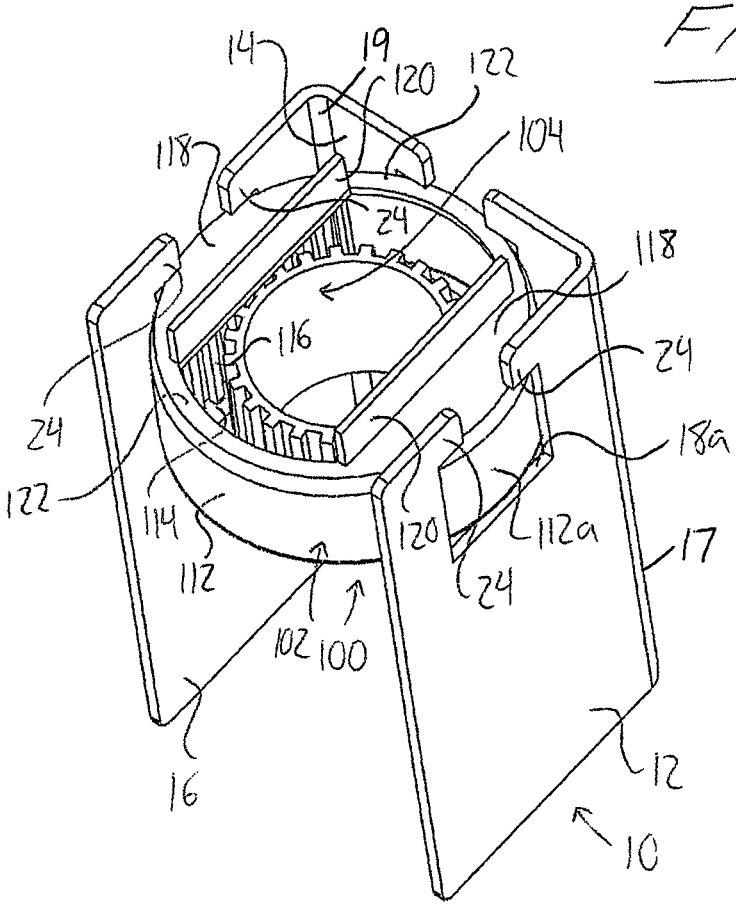
FIG. 1 is a top perspective view of a mounting accessory of the present invention installed on a mounting device that is used to support a hollow post around a pipe or pole, whereby the accessory presents a set of walls inside the hollow post to provide additional material for screw fasteners to engage into during fastening of a rail to the post.
Figure 2:
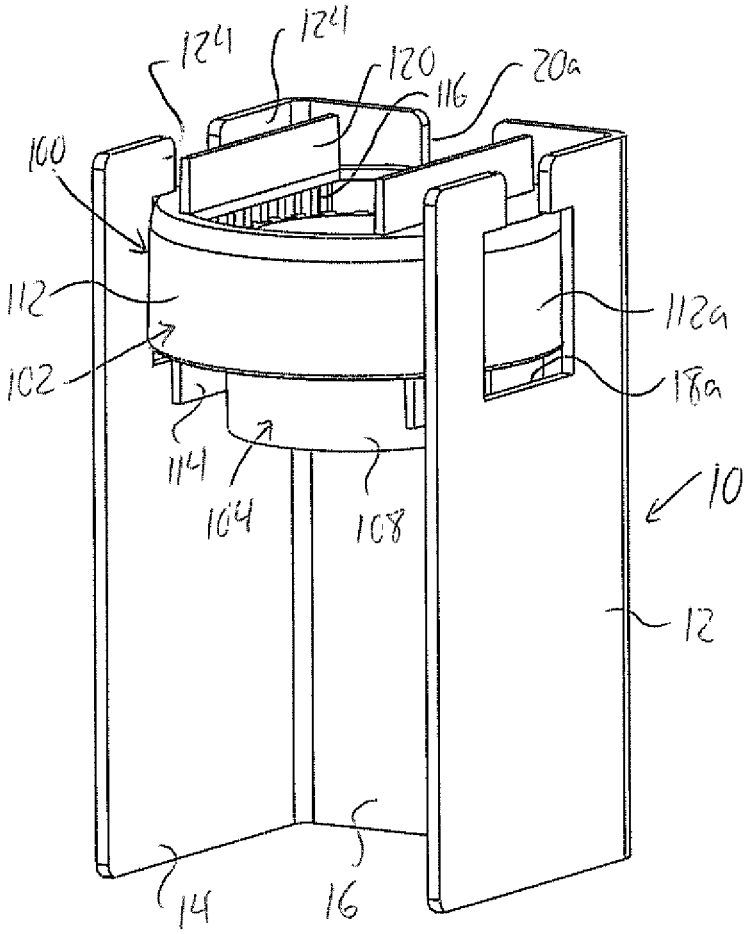
FIG. 2 is a side perspective view of the assembled mounting accessory and mounting device of FIG. 1.
Figure 3:
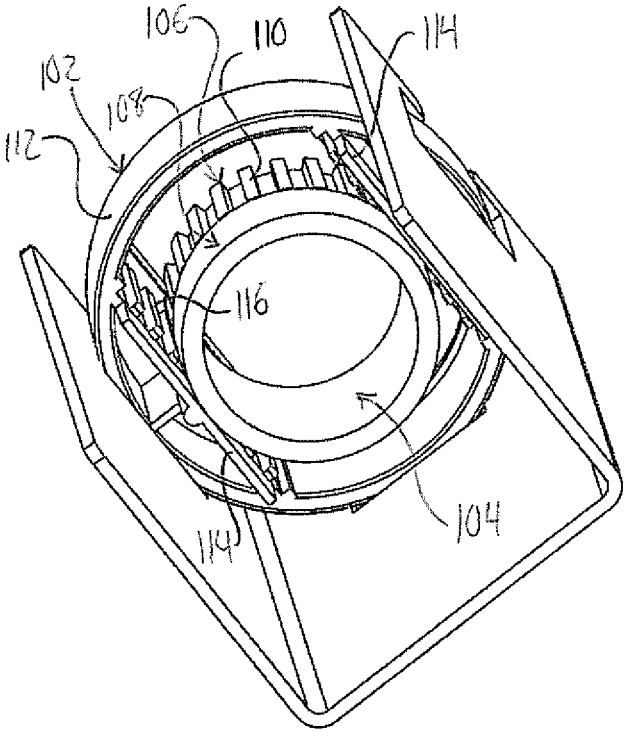
FIG. 3 is a bottom perspective view of the assembled mounting accessory and mounting device of FIG. 1.

FIG. 1 shows a mounting accessory 10 of the present invention in combination with a mounting device 100 of the type shown in FIGS. 9 to 11 of Applicant's aforementioned U.S. patent. The mounting accessory of the illustrated embodiment features three substantially rectangular walls 12, 14, 16 with adjacent walls connected together end to end at right angles to one another so that the walls delimit three sides of a rectangular volume. The mounting accessory 100 is arranged to mount on the outer piece 102 of the two-piece mounting device in a manner placing the planar outer face of each wall 12, 14, 16 in or closely adjacent to a respective tangential plane of the circularly-cylindrical outer peripheral surface 112 of the mounting device's outer piece 102. Accordingly, when the inner piece 104 of the mounting device is fastened to a pipe 200 on which a hollow post 300 is to be mounted, and the outer piece 102 of the mounting device is set on the inner piece 104 in a desired one of the numerous selectable positions thereon to set the position of the outer piece's central axis relative to the coincident axes of the inner piece and the pipe, the outer face of each wall 12, 14, 16 of the mounting accessory 10 will lie adjacent the inner surface of a respective one of the rectangular post's four planar walls, so that any screw driven through that wall of the post, for example to attach a rail thereto, will thereby be driven into the respective wall of the mounting accessory, thereby improving the retention of the screw and the rail or other item being secured therewith.

Figure 6:
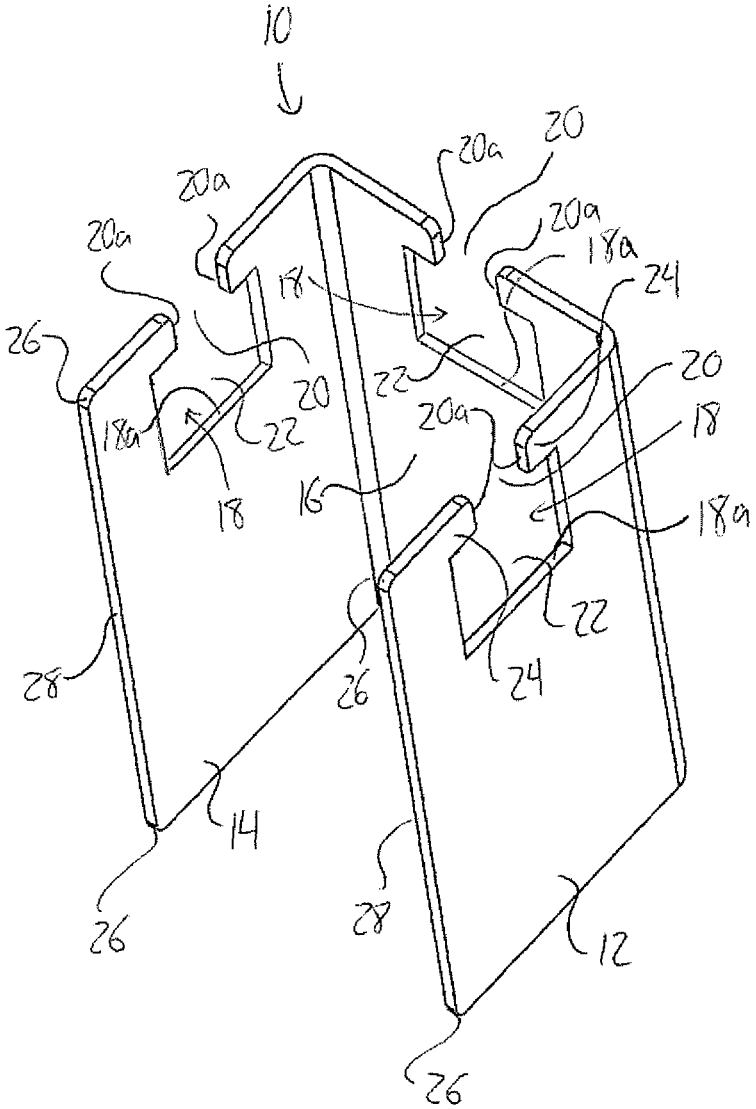
FIG. 6 is a top perspective view of a mounting accessory of FIG. 1 in isolation.

As best shown in FIG. 6, each wall 12, 14, 16 of the mounting accessory 10 has an inverted T-shaped opening 18 therein, featuring an upper slot 20 jutting vertically downward into the wall from its top edge to define the stem portion of the opening's T-shape, and a lower rectangular portion 22 having a greater width of the slot 20 so as to form the transverse portion of the opening's T-shape that lies crosswise to the lower end of the slot 20. The inverted T-shape of the opening thus defines a pair of overhanging portions 24 of the wall 12, 14, 16 that jut inwardly from opposite sides at the top of the lower rectangular portion 22 of the opening 18 to define the opposing sides 20*a* of the narrower slot 20 thereof. Each wall 12, 14, 16 would otherwise be substantially rectangular in its surface area if not for the T-shaped opening overlapping the upper end of the wall, and the optional slightly radiuses corners 26 at the two free ends 28 of the walls.

The preferred use of rectangular accessory walls of only slightly less width than the walls of the hollow post maximizes the available area at which the accessory can have screws driven into it. The accessory 10 is preferably formed as a unitary piece of molded plastic so as to provide integral joining of each wall to the adjacent wall at the corner edge therebetween, and has resilient flexibility at these inter-wall connections to allow manual deflection of one wall away from the others out of its normal position at approximately ninety-degrees to the adjacent wall by flexing of the resilient portion into a temporary position lying at an acute oblique angle relative to its normal position, to which the wall returns under the automatic return action of the resilient material. Accordingly, a first resilient area 17 is defined by the connection between walls 12 and 14, and an additional resilient area 19 is defined by the additional connection between walls 14 and 16.

The inner piece 104 of the mounting device 100 is a round cylindrical collar having a smooth-walled circular through-bore passing centrally therethrough, and distinct upper and lower exterior portions 106, 108, the upper one 106 of which features rib-like teeth 110 projecting radially outward at spaced apart positions around the collar and each extending axially therealong. The lower portion 108 of the collar's exterior is untoothed, instead having a smooth, continuous round outer wall closing in a concentric circular path around the central axis of the collar. The toothed upper portion engages the other piece of the mounting device in the manner described below, while the untoothed lower portion leaves cylindrical a wall of uniform thickness for driving of a screw therethrough into the pipe to secure the inner piece to the pipe at a location below where the outer piece will seat so as not to interfering with the mating teeth of the two pieces.

The outer piece 102 of the mounting device features an outer wall 112 of hollow cylindrical form closing circularly around a central axis of the piece. A pair of planar, parallel chord walls 114 extend across the interior of the outer wall 12 in planes parallel to the central axis of the cylindrical outer wall at respective chords of the circular cross-section thereof, thereby defining a central opening between the two chord walls 114. On each chord wall, spaced apart rib-like teeth 116 each project perpendicularly inward from the chord wall into the central opening therebetween and each extend parallel to the central axis passing through the central opening. Each tooth on one chord wall aligns with a respective tooth on the other on an imaginary line perpendicular to the two chord walls. The segment of the outer wall's circular cross-section bound by each chord wall 114 and the respective arcuate portion of the outer wall between the ends of the chord wall is covered at the top of the outer wall by a respective web portion 118 of the piece, which extends inwardly past the chord wall 114 to also create a short overhang into the central opening. A respective upright wall 120 lies parallel to each chord wall 114 at the free end of this overhanging portion of the web and projects upward therefrom, spanning the length of the respective side of the central opening. Each chord wall 114 extends downwardly past the bottom end of the outer wall.

The outer diameter of the toothed upper portion of the inner piece 104 at any pair of diametrically opposite teeth thereof is slightly less than the perpendicular distance across the central opening of the outer piece from one chord wall thereof to the other, while the linear distance between any pair of aligned teeth on the two chord walls of the outer piece in a direction perpendicular to the chord walls is less than the outer diameter of the toothed upper portion at any pair of diametrically opposed teeth thereof. The spacing of the teeth on the inner piece 104 and the spacing of the teeth on the outer piece 102 are such that any tooth of the inner piece will fit between any neighbouring pair of teeth on either chord wall. As a result, the inner piece can be nested into the central opening of the outer piece from therebelow by sliding a pair of diametrically opposed teeth on the inner piece upwardly into the respective receiving spaces defined between aligned pairs of teeth on the two chord walls of the outer piece. The overhanging portions of the webs of the outer piece are used to seat the outer piece atop the inner piece when the pieces are nested together in this manner. A length of the outer piece's central opening, measured parallel to the chord walls at a central location therebetween, exceeds the width of the opening and the outer diameter of the inner piece. Accordingly, the two pieces can be engaged together in any of a number of different relative positions, each corresponding to engagement diametrically opposite teeth on the inner piece into a different pair of aligned receiving spaces defined between aligning pairs of adjacent teeth on the chord walls.

The drawings show the two pieces engaged in a concentric one of these relative positions, where the parallel central axes of the two annular or ring-like pieces are coincident. Selecting a different nested position of the two pieces allows the axis of the outer piece to be offset from that of the inner piece, which is fastened to a pipe that has been anchored in an upright position projecting upward from the ground or other suitable base. The outer periphery of the outer cylindrical wall of the outer piece is of suitable diameter to frictionally engage against inner surfaces of a hollow rectangular post of predetermined cross-sectional size. The outer piece is alternatively usable without the inner piece, as the upright walls 120 and the extension of the chord walls downward past the bottom end of the cylindrical outer wall 112 allow any such wall to be directly fastened to the pipe with a screw after sliding the outer piece onto the pipe to have the pipe extend through the central opening of the outer piece at any selectable position along the elongated central opening.

Turning back now to the mounting accessory 10 of the present invention, the lower rectangular portion 22 of the opening in each wall 12, 14, 16 has a height that slightly exceeds the axial height of the outer cylindrical wall 110 of the outer piece 102 of the mounting device, as measured from the bottom end of the wall to the coplanar upper surfaces of the webs 118 (which in the illustrated embodiment includes the height of a tapered rim of the piece that extends around the top end of the cylindrical outer wall and joins the same to each web 118). The normal rectangular space bound on three sides by the walls of the mounting accessory in their normal states has a square cross-section whose length and width is slightly less than the outer diameter of the cylindrical outer wall of the mounting device's outer piece.

To install the mounting accessory onto the outer piece 102 of the mounting device 100, a user holding the accessory 10 flexes at least one of the two opposing side walls 12, 16 away from the other to increase the size of the gap between those side walls 12, 16 at the ends thereof opposite the third side wall 14 that interconnects them. Holding the walls in this condition against their resilient bias back into their normal right-angle relationships with one another, the enlarged gap between the opposing walls is moved across the outer piece of the mounting device to bring the outer piece of the mounting device into the space bound on three sides by the walls of the mounting accessory, with the height of the outer wall of the outer mounting piece aligned with the heights of the lower portions 22 of the openings in the walls of the mounting accessory, until one or two arcuate portions 112*a* of the mounting piece's cylindrical outer surface is/are brought into respective registration with one or two of the wall openings 18 at the lower portion 22 thereof. Having achieved this, the wall-spreading force on the accessory is released, thereby returning the walls back to their default positions at right angles to one another under the resilient bias of the accessory, thereby causing each of the previously empty remaining wall opening(s) of the accessory to likewise receive a respective arcuate portion 112*a* of the mounting pieces's outer wall surface in or through the wall opening of the accessory.

As a result of this, the overhanging portions 24 of each wall 12, 14, 16 of the accessory 10 jut toward one another over the outer cylindrical wall of the mounting piece to positions, preferably reaching past the inner surface of this wall to overlie a respective one of the webs 118 or a respective one of two arcuate flanges 122, each of which projects a short distance inward from the top end of the cylindrical outer wall in the same plane as the webs 118 at opposite ends of the central opening to thereby form integral connections between the two webs 118. The overhanging portions 24 of the walls 12, 14, 16 thereby act to hang the remainder of the accessory 10 from the outer mounting piece 102.

The accessory may be installed on the outer mounting piece 102 before or after installation thereof on the pipe, whether directly or via the inner mounting piece 104, which is fastened to the upright pipe on which the hollow post is to be mounted, for example by driving of a screw fastener through the untoothed lower portion of the inner piece 102.

Downward movement of the accessory 10 relative to the outer mounting piece 102 is prevented by the seating of the overhanging wall portions 24 on the inwardly extending webs and flanges of the outer mounting piece 102, and upward movement of the mounting accessory relative to the outer mounting piece 102 is limited by contact between the bottom edge 18*a* of the opening 18 in each accessory wall 12, 14, 16 with the bottom edge of the cylindrical outer wall 112 of the outer mounting piece 102. Due to the close sizing of the opening's lower portion 22 relative to the cylindrical wall height of the outer mounting piece, significant displacement of the installed accessory 10 along the axial direction of the mounting device is thus prevented.

Figure 4:
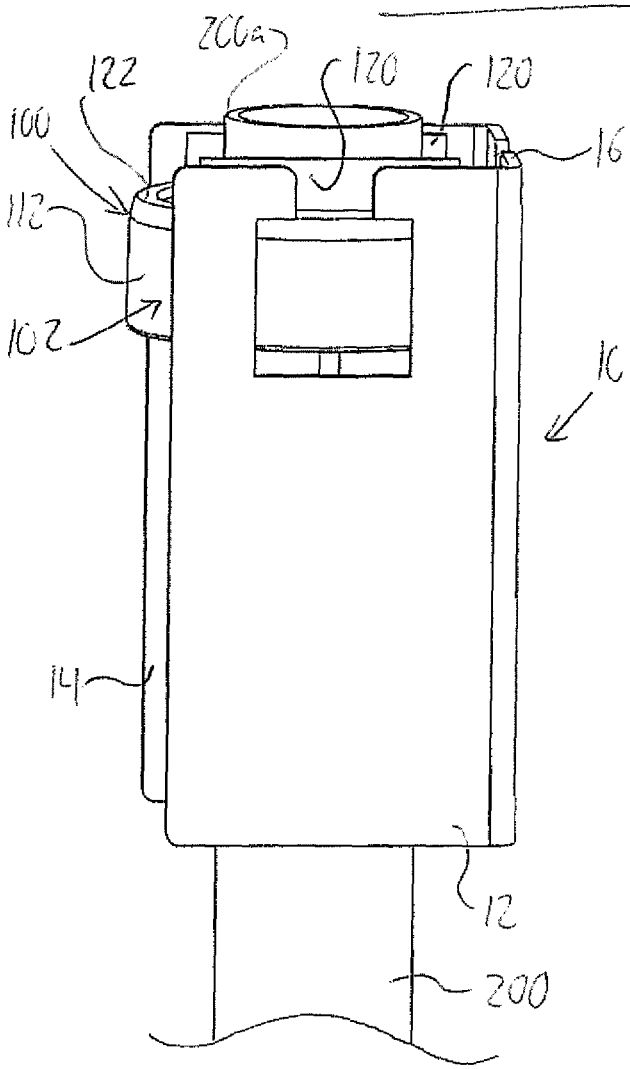
FIG. 4 is a side perspective view of the assembled mounting accessory and mounting device of FIG. 1 installed on a pipe and ready for receipt of a hollow post thereover.

While significant up and down movement of the accessory 10 relative to the mounting device is prevented in this manner, rotation of the installed accessory about the axis of the outer mounting piece is allowed. Accordingly, with reference to FIG. 4, where the mounting device 10 and accessory 100 are installed on an upright pipe 200 to which the inner mounting piece 104 has been screwed before placement of the outer mounting piece 104 onto the inner mounting piece, an installer can face any wall of the accessory 10 in a desired direction by rotating the accessory around the axis of the outer mounting piece to place that wall on a desired side of the pipe 200 where a rail is be coupled to the hollow post that will be fitted over the pipe. FIG. 4 shows the assembled mounting device 10 and mounting accessory installed near the upper end 200*a* of the upright pipe 200, for example for use in the post of a stair banister, where a handle rail is to run between two posts near the top ends thereof, or use in a fence or deck railing where top and bottom rails are to be run between two posts near the upper and lower ends thereof respectfully. Accordingly, while the drawing shows only an upper pairing of a post-mounting device 10 and rail mounting accessory 100 near the top end of the upright 200, it will be appreciated that a rail mounting accessory can also or alternatively be used at lower or intermediate locations along an upright according to the desired number of rails and elevations thereof for a particular application.

Figure 5:
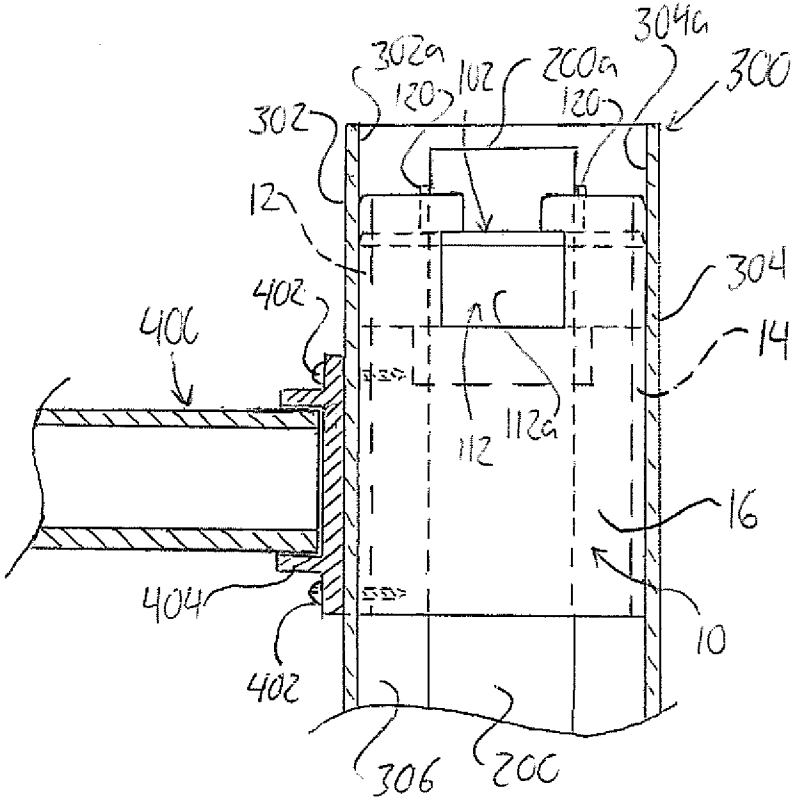
FIG. 5 is an elevational view of the of mounting accessory, mounting device and pipe of FIG. 4 after further installation of the hollow post and railing, which are shown in cross-section for illustrative purposes.

FIG. 5 shows the assembled components of FIG. 4 after further installation of a rectangular hollow post 300 and upper rail 400. The post is installed by sliding its open lower end downward over the top end 200*a* of the pipe 200 to slide its four walls down into positions closing around the mounting accessory 10 around the mounting device 100. Three of the four walls of the cross-sectioned hollow post 300 are visible in the drawing at 302, 304, 306. Three of the post walls (visible walls 302, 304, and the remaining wall omitted by the cross-sectioning of the post) respectively overlie the three walls 12, 14, 16 of the mounting accessory 10. The inner face of these three post walls, two of which are visible at 302*a* and 304*a*, are each frictionally engaged by the assembled combination of the mounting device 10 and mounting accessory 100. This frictional engagement may be achieved at the arcuate portion 112*a* of the outer mounting piece's cylindrical outer wall where this portion 112*a* bulges fully through the opening 118 at the respective wall of the accessory, by the outer face of the respective wall of the accessory if the mounting piece's outer arcuate portion 112*a* doesn't bulge fully through the outer side of the wall opening 118, or through a combination of the arcuate portion of the mounting piece's outer wall and the outer face of the accessory wall if the apex of the arcuate portion 112*a* of the accessory wall is coplanar with the outer face of the accessory wall. The close sizing of the cross-sectional outer dimensions of the mounting accessory 10 to the inner dimensions of the post not only provides this abutting or closely-spaced fitting between the outer faces of the accessory walls and the inner faces of the post walls, but also prevents relative rotation between the post and the mounting accessory. Accordingly, with the hollow post in place over the mounting accessory, these two pieces can be rotated together by manual rotation of the post about the axis of the outer mounting piece in order to face the walls of the post in appropriate directions.

The combined assembly of the mounting device 10 and mounting accessory perform the mounting device's original intended function of internally bracing the post walls at positions outward from the pipe, while the accessory also provides the additional function of presenting additional walls positioned internally adjacent three of the post's outer walls to provide additional material for screws to thread into when driven through any one of these post walls. FIG. 5 shows a railing 400 having been attached to the post 400 in this manner in an orientation horizontally approaching the post from side thereof to which post wall 302 faces. In a conventional manner, a support bracket 404 has a flat face at one end for placement against the flat outer face of the rectangular post wall 302 and an open socket at the other end for receipt of a respective end of the rail 400, and screws 402 are driven through a flanged or rim portion of the bracket that projects outward from the socket at the flat-faced closed end thereof. In the present invention, the screws 402 are long enough to pass fully through the bracket and post wall 302, and thereby engage into the respective accessory wall 12 positioned internally against or closely adjacent this post wall 302, preferably also passing fully through the accessory wall 12 to take full advantage of the material thickness thereof to provide the maximum possible strength at this screw-fastened connection of the rail 400. While the illustrated embodiment shows a rail and bracket configuration of a type used in PVC fencing and decking, it will be appreciated that the mounting accessory may be used with rails and hollow posts of different materials, whether fastened indirectly through use of a bracket or employing rails that are preconfigured for direct fastening to the post. Likewise the mounting accessory may be used in fastening of other non-rail pieces to hollow posts, whether structural or ornamental, in order to better secure and stabilize such attachments.

The illustrated embodiment features three walls in order to maximize the number of post walls that are to be internally backed by the accessory for option fastening to the post and accessory at any one or more of those post walls while employing the described use of the gap between two walls of the accessory in order to install it on the cylindrical-periphery mounting device.

However, an alternate embodiment may feature only two opposing walls that are somehow joined together by means other than a third wall spanning between them, for example by two strip-like horizontal pieces of material joining together top edges of the two walls adjacent opposing ends of each of these edges, whereby these strips would connect the two walls across the mounting device on opposite sides of the central opening therein through which the pipe extends. To install such a device, the lower ends of the two walls would be flexed away from one another to accommodate receipt of the mounting device between them from below for sliding up to the wall openings of the accessory, where the walls would be released to capture diametrically opposite arcuate portions of the mounting device in the wall openings of the accessory. Such a design would not require the wall openings to extend up to the top edge of the walls, as the connecting strips between the walls would providing the accessory-hanging functionality of the overhanging wall portions 24 of the illustrated embodiment, and so the opening may be in the shape of a single rectangular window fully bound on all four sides by the remainder of the wall.

Another embodiment may employ only two adjacent walls connected resiliently or rigidly end-to-end at a right angle to one another in the default state of the resilient connection between them, and feature some inwardly projecting feature atop one or both of the accessory walls that can be seated atop the inwardly projecting features at the top of the cylindrical wall of the mounting for passage of a fastener through these overlapping features of the accessory and mounting device to secure the accessory on the mounting device after positioned in a manner setting the accessory walls at desired sides of the mounting device. However, this arrangement would not present opposing walls that allow use of a single accessory to present fastener-engagable walls on opposing sides of the pipe, as is required for intermediate posts along a linear section of fence or railing. Accordingly, the three-walled illustrated embodiment is preferred as the same piece can be used for an end post having only one rail attached to it, an intermediate post having two rails attached to it from opposite sides, or a corner post having two rails attached to it from adjacent sides disposed at right angles to one another.

While the mounting accessory has been described above in terms of a multi-piece mounting device disclosed in Applicant's previous patent for the purpose of allowing user-control over axial alignment between the pipe and hollow post, it will be appreciated that the mounting accessory 10 for strong attachment of rails to a hollow post structure may similarly be used in conjunction with other mounting devices that also feature outer peripheries having round cylindrical shapes or arcuate portions that can be accommodated in wall openings of the accessory, including mounting devices that are not configured for user-controlled angulation between the pipe and post.

For example, the illustrated embodiment may be used on a mounting device of type shown in FIG. 12 of Applicant's aforementioned patent, which also allows the user to set the post position/orientation, or of the type shown in U.S. Pat. No. 6,523,808, the entirety of which is also incorporated herein by reference, which does not allow the user to set the post position relative to the pipe, but still uses a round cylindrical outer wall to brace against the inside of the post walls.

Figure 7:
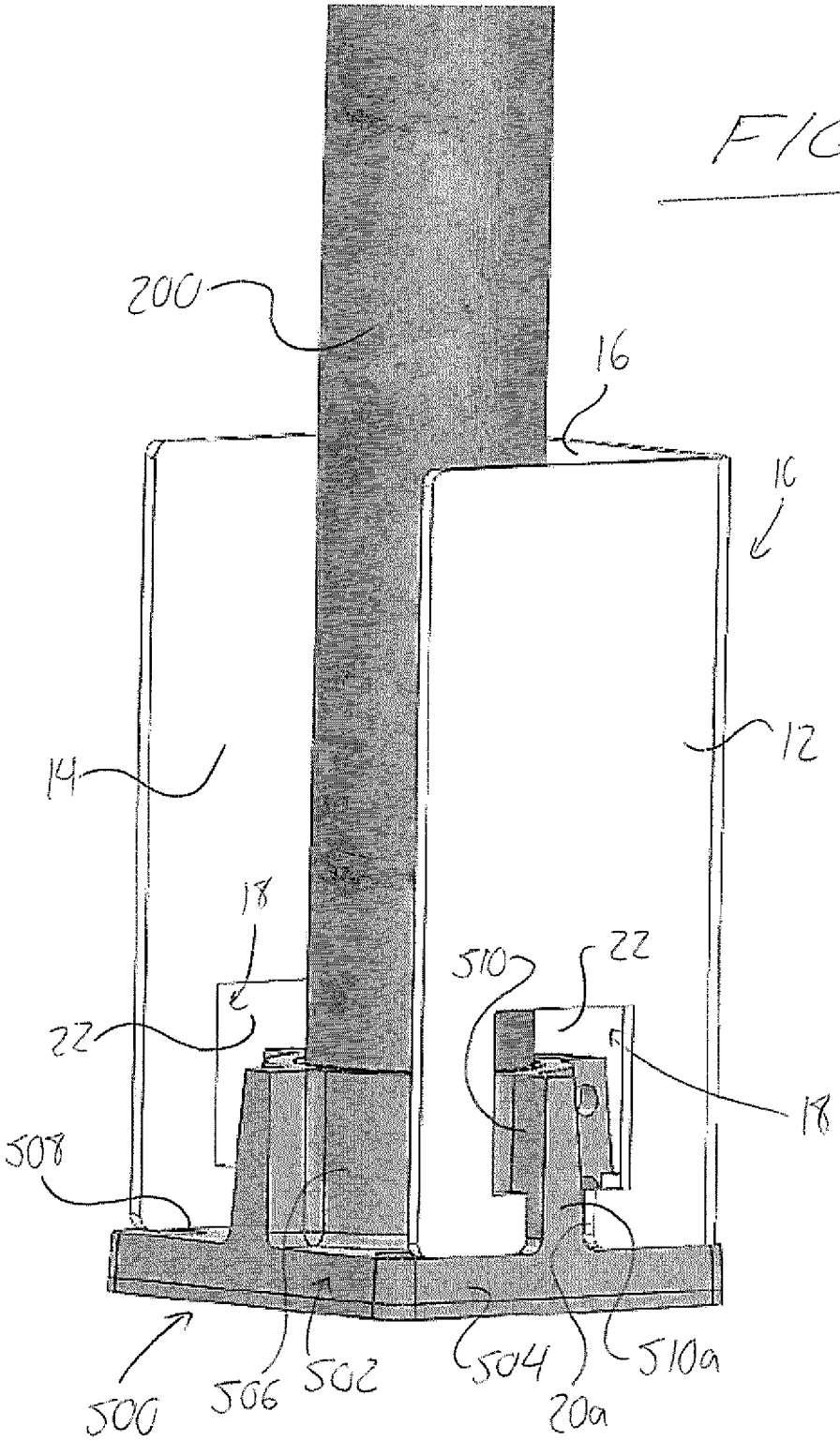
FIG. 7 is a side perspective view of the mounting accessory of claim 7 installed in combination with a different style of mounting device used at the base of an upright pipe to support the lower end of a hollow post to be placed thereover.

A further example of use of the illustrated mounting accessory on a different type of mounting device at a different elevation along the pipe is now outlined with reference to FIG. 7, where the accessory 10 is used in an inverted position, where the narrower slot of each wall opening extends to the bottom of the accessory, in order to seat the slotted edge (now at the bottom of the accessory) atop an upward facing surface of a lower mounting device 500 having a square base plate 502 of suitable dimension to frictionally engage perimeter edges 504 of the base plate against the inner surfaces of the four walls of the rectangular hollow post. A cylindrical collar 506 projects centrally upward from the base plate 502 and has an inner diameter sized to snugly receive the upright pipe 200 concentrically therein. The base plate 502 may feature a central through-hole communicating with the hollow interior of the collar 506, for example for use of the lower mounting device 500 to engage a bottom portion of a hollow post fitted over a pipe whose lower end is engaged in the ground through the hole in the base plate. Alternatively, the base plate 502 may close off the bottom end of the collar 506 so that the lower end of the pipe is seated on the base plate, which in turn is anchored to the ground or other suitable horizontal surface via fastener holes 508 passing through the base plate 502 at positions radially outward from the collar 506.

To limit rotation of the mounting accessory 10 relative to the lower mounting device 500 in order to keep each wall of the mounting accessory in a position extending along a respective side of the square base plate adjacent the respective outer edge thereof, the illustrated lower mounting device 500 features a guide rib 510 projecting gradually outward from the collar to the side edge of the base plate at a central location along each side thereof. The height of the guide rib extends upward within the wall opening 118 of the accessory through the slot 20 thereof, where contact of the opposite sides 20*a* of this slot 20 of the opening with the opposite sides of the guide rib acts to limit the degree of possible rotation of the accessory around the collar axis and the pipe axis coincident therewith. Each perimeter edge 504 of the base plate, and the outer end 510*a* of each guide rib 510 situated thereat, may be angled slightly inward toward the collar axis so that the overall lower mounting device 500 is tapered to slightly increase in cross-sectional size moving toward the bottom of the base plate so that the frictional fit of the mounting device 500 against the post tightens as the post is lowered further over the device.

It will be appreciated that the mounting accessory 10 may likewise be seated on base or lower mounting devices of other shapes or configurations to likewise place it walls adjacent the inner wall surfaces of a post fitted on or over the device. For example, the accessory 10 could be seated on a device having a round base plate or flange arranged to have the post seated thereatop or frictionally engaged therearound, and such a device may or may not include guide ribs to limit relative rotation between the device and the mounting accessory.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. In combination, a hollow post, an internal upright support over which the hollow post resides in a position closing therearound, a mounting device having an axial passage through which the internal upright support passes and having an outer periphery facing outwardly away from the passage at a distance outward therefrom in frictional contact with walls of the hollow post, and an internal mounting accessory comprising interconnected walls having inner faces facing into an open space left between said walls, the internal upright passing through the open space of the internal mounting accessory, the interconnected walls of which are situated on different sides of the internal upright support, each one of the interconnected walls of the internal mounting accessory having an opening therein through which a respective portion of the periphery of the mounting device extends into frictional contact with a respective one of the walls of the hollow post to support the hollow post in place over the internal upright support, whereby the interconnected walls of the internal mounting accessory cooperate with the respective walls of the hollow post to provide an increased material thickness that is engagable by threaded fasteners driven through one or more of said respective walls of the hollow post to attach a rail or other component thereto.

2. The combination of claim 1 wherein a connection between two of the interconnected walls of the internal mounting accessory comprises a resilient area that is flexible out of a normal unflexed condition to enable selective moving of the inner faces of said two of the interconnected walls away from one another.

3. The combination of claim 2 wherein said two of the interconnected walls of the internal mounting accessory are connected end to end and, with the connection in the normal unflexed condition, lie in perpendicular planes.

4. The combination of claim 3 wherein the interconnected walls of the internal mounting accessory comprise a third wall connected end to end with one of said two of the interconnected walls to lie parallel to the other of said two of the interconnected walls with the connection in the normal unflexed condition.

5. The combination of claim 3 comprising an additional connection between a third one of the interconnected walls and a first one of said two of the interconnected walls, the additional connection comprising an additional resilient area that is flexible out of a respective normal unflexed condition to enable selective moving of the third one of the interconnected walls away from the inner faces of said two of the interconnected walls.

6. The combination of claim 5 wherein the third one of the interconnected walls is perpendicular to the first one of said two of the interconnected walls with the additional connection in the respective normal unflexed condition.

7. The combination of claim 4 wherein the interconnected walls of said internal mounting accessory consists of said two of the interconnected walls and said third one of the interconnected walls.

8. The combination of claim 1 wherein the opening in each of the interconnected walls of said internal mounting accessory is disposed between, and spaced from each, of top and bottom ends thereof.

9. The combination of claim 8 wherein at least one wall of the interconnected walls of said internal mounting accessory comprises a respective slot that is narrower than the opening in said at least one wall and that extends from said opening to a respective one of the top and bottom ends of said at least one wall.

10. The combination of claim 1 wherein said mounting device comprises an outer cylindrical wall defining the periphery of said mounting device on a circular path around the passage, the openings in the interconnected walls of the internal mounting accessory each having an upper boundary seated on a top end of the cylindrical wall of the mounting device.

11. The combination of claim 1 wherein the openings in the interconnected walls of said internal mounting accessory are rectangular in shape.

12. The combination of claim 1 wherein the interconnected walls of said internal mounting accessory are rectangular in shape.

13. The combination of claim 1 wherein each one of the interconnected walls of said internal mounting accessory extends both upwardly and downwardly past the opening therein.

14. In combination, a hollow post, an internal upright support over which the hollow post resides in a position closing therearound, a mounting device having an axial passage through which the internal upright support passes and an outer cylindrical wall facing outwardly away from the passage on a circular path therearound in frictional contact with walls of the hollow post, and an internal mounting accessory comprising interconnected walls having inner faces facing into an open space left between said interconnected walls, the internal upright passing through the open space of the mounting accessory, the interconnected walls of which are situated on different sides of the internal upright support, each of said interconnected walls of said internal mounting accessory having an opening therein through which a respective arcuate portion of the cylindrical wall of the mounting device extends into frictional contact with a respective one of the walls of the hollow post to support the hollow post in place over the internal upright support, whereby the interconnected walls of the internal mounting accessory cooperate with the respective walls of the hollow post to provide an increased material thickness that is engagable by threaded fasteners driven through one or more of said respective walls of the hollow post to attach a rail or other component thereto.

* * * * *